United States Patent [19]

Timme

[11] Patent Number: 4,850,224

[45] Date of Patent: Jul. 25, 1989

[54] IMPACT APPARATUS

[76] Inventor: William F. Timme, 891 Amaryllis Ave., Oradell, N.J. 07649

[21] Appl. No.: 168,588

[22] Filed: Mar. 3, 1988

Related U.S. Application Data

[63] Continuation of Ser. No. 883,121, Jul. 8, 1986, abandoned.

[51] Int. Cl.[4] ..... A61B 5/22

[52] U.S. Cl. ..... 73/379; 272/77

[58] Field of Search ..... 73/379; 272/76, 77, 272/DIG. 5

[56] References Cited

U.S. PATENT DOCUMENTS

| | | | |
|---|---|---|---|
| 482,623 | 9/1892 | Dooling | 73/379 |
| 2,051,042 | 8/1936 | Hendel et al. | 73/146 |
| 2,820,365 | 1/1958 | Detzel | 73/380 |
| 2,940,312 | 6/1960 | Smith et al. | 73/379 |
| 3,081,634 | 3/1963 | Blaszkowski | 73/379 |
| 3,611,807 | 10/1971 | Brandell | 73/379 X |
| 4,114,449 | 9/1978 | Dikeman et al. | 73/379 |
| 4,131,012 | 12/1978 | Courtiol | 73/11 X |
| 4,199,987 | 4/1980 | Bauers et al. | 73/379 |
| 4,463,951 | 8/1984 | Kumasaka et al. | 273/58 B A X |
| 4,467,660 | 8/1984 | McMillan, Jr. | 73/861.87 |
| 4,534,557 | 8/1985 | Bigelow et al. | 73/379 X |

FOREIGN PATENT DOCUMENTS

| | | | |
|---|---|---|---|
| 2708072 | 8/1978 | Fed. Rep. of Germany | 73/379 |

*Primary Examiner*—Charles A. Ruehl

*Attorney, Agent, or Firm*—Robin, Blecker & Daley

[57] ABSTRACT

An impact apparatus employing a hollow body having within its interior resilient means having a greater resiliency than said body.

11 Claims, 1 Drawing Sheet

IMPACT APPARATUS

This application is a continuation of application Ser. No. 883,121, filed July 8, 1986.

BACKGROUND OF THE INVENTION

This invention relates to an impact apparatus and, in particular, to an impact apparatus for providing an indicia or measure of the impact applied to the apparatus.

In the training of athletes, particularly those involved in contact sports such as, for example, boxing, football, and karate, it is important to be able to assess the punching power of the athlete and how it improves with continued training. To meet this need, a variety of impact devices or pads have been developed which permit impact power to be gauged. Many of these devices, however, depend upon mechanical linkages and other complicated structures. Furthermore, these devices often do not rapidly recover after an impact, making them undesirable for use where a rapid succession of impacts is to be measured.

It is therefore an object of the present invention to provide animpact apparatus which does not suffer from the above disadvantages.

It is further object of the present invention to provide an impact apparatus which uses a minimum of mechanical parts and is less expensive to manufacture.

It is yet a further object of the present invention to provide an impact apparatus which has a rapid recovery time and thus can be used to measure the impact of a rapid succession of blows.

SUMMARY OF THE INVENTION

In accordance with the principles of the present invention, the above and other objectives are realized in an impact apparatus comprising an impact resistant, hollow body having in its interior adjacent at least a part of its inner wall a resilient means whose resiliency is greater than that of the body. The resilient means defines a chamber which communicates with an indicating device which is responsive to air expelled from the chamber upon a change in the volume of the chamber due to impact or force being applied to the body. The indicating device thus provides a measure of this impact.

Due to the greater resiliency of the inner resilient means, the chamber of the impact apparatus recovers its original configuration quickly and rapidly, causing the less resilient outer body to also quickly recover its shape. The apparatus thus rapidly returns to its original condition for receipt of another blow. Successive impacts can therefore be quickly applied to the apparatus and the extent of these impacts measured.

In a further aspect of the present invention, the indicating device is in the form of a rotating device or wheel whose number of rotations is dependent upon the degree of air expelled from the chamber and, thus, the decrease in volume of the chamber resulting from the applied impact. A sensor in the indicating device senses the number of rotations of the wheel and provides a digital signal to a digital readout device whose output is thus indicative of the rotations and thus the impact. With the use of the rotating wheel there is sufficient venting in the housing to the atmosphere that no pressure build-up in the system occurs.

In yet a further aspect of the invention, the impact apparatus is provided with a distant gauge which permits the user to be situated determinable distances from the pad.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 1:
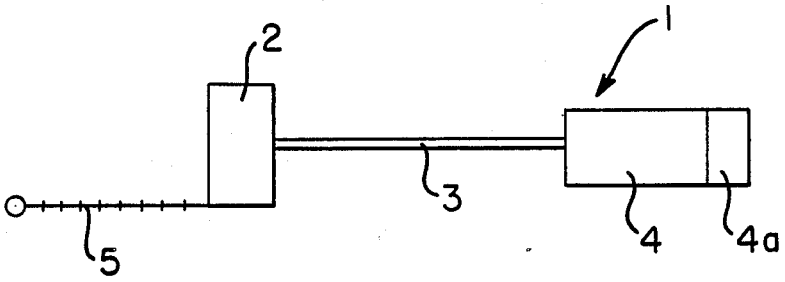
FIG. 1 shows the impact apparatus of the present invention.

In FIG. 1, the impact apparatus 1 of the invention is shown. The apparatus 1 comprises an impact pad 2 to which impact or force is applied by the individual utilizing the apparatus. A conduit 3 connects the pad 2 to an indicating device 4 which provides a numerical output in readout section 4*a* indicative of the impact applied to the pad 2.

Figure 2:
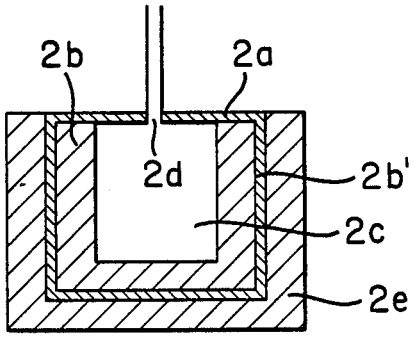
FIG. 2 illustrates schematically in cross section the impact pad of the apparatus of FIG. 1.

As shown in FIG. 2, the pad 2 comprises a high impact, hollow, thin body 2*a*, typically formed by a high impact polyethylene or plastic, in whose interior is disposed a resilient means 2*b* whose resiliency is greater than that of the body 2*a*. As shown, the resilient means 2*b*, is adjacent to the inner wall 2*b*′ of body 2*a* and defines therewith an air chamber 2*c*. The chamber 2*c* communicates with the conduit 3 via an opening 2*d* in the body 2*a*.

Typically, the resilient means 2*b* is formed from a polyurethane foam and has a resiliency which permits rapid recovery of the means to its original shape after being deformed by impact. In the case shown, the pad 2 also includes an additional outer layer 2*e* which provides exterior support for the inner elements 2*a* and 2*b* and which also provides added striking area. The outer layer can comprise a foamed material, polyethylene foam being preferable.

In operation of the impact apparatus 1, when force or impact is applied to the pad 2, the body 2*a* and resilient means 2*b* are deformed causing the volume of chamber 2*c* to decrease. As a result, air is expelled from the chamber 2*c* and passes through the opening 2*d* into the conduit 3. The conduit 3, in turn, carries the air to the indicating device 4 which provides a numerical readout indicative of the force of the blow.

After impact has been applied and a readout realized, it is important that the chamber 2*c* return to its original volume so that measurement of another blow can be taken. In accordance with the invention, by providing the quick recovery resilient means 2*b* in the interior of the resilient body 2*a*, the chamber 2*c* returns to its original state quickly and rapidly without the need of pressure from any air returning to the chamber. Accordingly, the impact apparatus 1 regains its original ready state quickly, allowing for a rapid succession of impacts to be measured.

Figure 3:
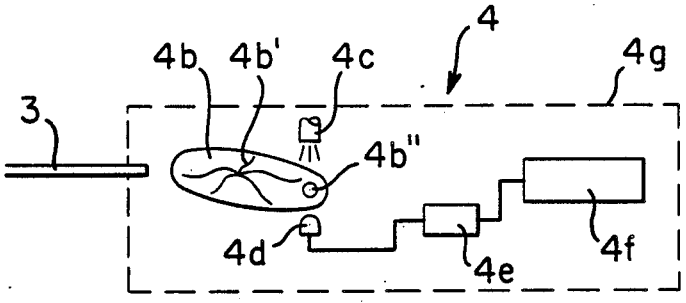
FIG. 3 shows the indicating device of the impact apparatus of FIG. 1.

The indicating device 4 of the apparatus 1 may take a variety of forms and may be adapted to provide an indication directly in pounds per square inch. In a further aspect of the present invention, the indicating device is of simplified construction and, as shown in FIG. 3, includes a rotary disc 4*b* having vanes 4*b*′ upon which impinge via conduit 3, the air from the chamber 2*c* whem impact is applied to the pad 2. This causes the wheel to rotate, with the number of rotations of the wheel 4b being related to the expelled air and, therefore, to the impact applied to the pad.

The rotations of the wheel 4b are counted optoelectrically utilizing a light source 4c, such as, an infra red LED, which directs light at the periphery of the wheel which is provided with an aperture 4b''. Below the wheel and in line with the light source 4c is a receiver 4d, such as, a photo transistor, which receives light from the source 4c each time the aperture 4b'' aligns with the source. Thus, the receiver 4d receives light once per revolution of the disc 4b.

The receiver 4d, in turn, in response to this light generates an electrical pulse which closes a relay 4e causing a count to occur in digital counter 4f. The counter 4f thus counts the revolutions of the wheel 4b which, in turn, is a meausre of the air expelled from chamber 2c and, therefore, of the applied impact. The output of counter 4f thus provides a numberical indication of this impact.

With the indicating device 4 of FIG. 3, the components are housed in a housing 4g, shown in dotted line, which is sufficiently vented to prevent back pressure occuring in the system. The system, in this case, is therefore unpressurized and at substantially atmospheric pressure.

In practice of the present invention, the indicating device 4 can be adapted to provide a total count for consecutive impacts or can be adapted to provide an individual count for each impact. Furthermore, the device 4 can be adapted to be settable for either of these modes of operation.

In yet a further aspect of the present invention, the impact apparatus 1 is provided with a settable distance gauge 5 so that the user applies impact from a set or known distance from the pad. As shown, the gauge 5 is in the form of a cord which can be held at various marked distances so the user knows his or her distance to the pad. In this way, the user can provide impact to the pad from a constant distance, providing a more meaningful comparison of successive impacts.

It should also be noted that the impact apparatus 1 can be incorporated into a variety of conventional devices such as, for example, conventional punching bags, to provide a measure of impact to the user. Also, the apparatus 1 may be hand held or mounted to a stationary surface dependent upon the particular application. Finally, the conduit 3 can be mounted to the body 2a by any quick disconnect arrangement such as a male, female thread arrangement.

In all cases, it is understood that the aboveidentified arrangements are merely illustrative of the many possible specific embodiments which represent applications of the present invention. Numerous and varied other arrangements can readily be devised in accordance with the principles of the present invention without departing from the spirit and scope of the invention. For example, the indicating device 4 can be built into the impact pad 2, instead of being remote from the pad as shown in FIG. 1.

What is claimed is:

1. An impact apparatus comprising:

a hollow body;

resilient means in the interior of and in contact with the inner walls of said body, said resilient means defining a chamber in said body and having a greater resiliency than said body, whereby said resilient means recovers its shape after deformation resulting from impact to said hollow body to quickly cause said hollow body to recover its shape;

and means communicating with said chamber for receiving air expelled from said chamber and developing an electrical signal indicative of said expelled air.

2. An impact apparatus in accordance with claim 1 further comprising:

an outer layer surrounding said hollow body.

3. An impact apparatus in accordance with claim 2 wherein:

said hollow body comprises a high impact polyethylene material;

said resilient means comprises a polyurethane foam material; and said outer layer comprises a polyethylene foam material.

4. An impact apparatus in accordance with claim 1 wherein:

said hollow body comprises a high impact polyethylene material; and said resilient means comprises a polyurethane foam material.

5. An impact apparatus in accordance with calim 1 wherein:

said receiving means comprises: a conduit connected to said chamber for receiving the air expelled from said chamber; and indication means coupled to said conduit for developing said electrical signal.

6. An impact apparatus in accordance with claim 1 wherein:

said means communicating with said chamber comprises: a rotatably mounted wheel adapted to be rotated by said expelled air; and means for detecting the rotations of said wheel and for providing said electrical signal based on said detected rotations.

7. An impact apparatus in accordance with claim 6 wherein:

said wheel has an aperture on its periphery; and said detecting means includes: a light source directing light at said periphery of said wheel; a light receiver for receiving light from said light source passing through said aperture; and a digital counter responsive to said receiver.

8. An impact apparatus in accordance with claim 7 wherein:

said light source is an infra red LED;

said receiver comprises: a phototransistor; and a relay coupled between said phototransistor and said digital counter.

9. An impact apparatus in accordance with claim 1 wherein:

said hollow body comprises a high impact polyethylene material;

said resilient means comprises a polyurethane foam material.

10. An impact apparatus in accordance with claim 1 further comprising:

means for providing a determinable gauge of the distance to the apparatus.

11. An impact apparatus in accordance with claim 10 wherein:

said gauging means is a marked chord.

* * * * *